US008123708B2

(12) United States Patent
Wu et al.

(10) Patent No.: US 8,123,708 B2
(45) Date of Patent: Feb. 28, 2012

(54) MASSAGE DEVICE

(75) Inventors: Chichun Wu, Guangdong Province (CN); Chi-Wu Chiang, Guangdong Province (CN)

(73) Assignee: Weightec Electronic Technology Co., Ltd., Dongcheng, Dongguan, Guangdong Province (CN)

( * ) Notice: Subject to any disclaimer, the term of this patent is extended or adjusted under 35 U.S.C. 154(b) by 198 days.

(21) Appl. No.: 12/551,078

(22) Filed: Aug. 31, 2009

(65) Prior Publication Data

US 2010/0063428 A1 Mar. 11, 2010

Related U.S. Application Data

(63) Continuation-in-part of application No. 11/625,255, filed on Jan. 19, 2007, now Pat. No. 7,731,672, which is a continuation-in-part of application No. 11/082,016, filed on Mar. 16, 2005, now abandoned, said application No. 12/551,078 is a continuation-in-part of application No. 12/103,785, filed on Apr. 16, 2008.

(30) Foreign Application Priority Data

May 11, 2004 (CN) ..... 2004 2 00456092 U
Mar. 7, 2008 (CN) ..... 2008 2 0091616 U
Jul. 10, 2009 (CN) ..... 2009 2 0133730 U

(51) Int. Cl.
*A61H 7/00* (2006.01)
*A61H 15/00* (2006.01)
*A61H 19/00* (2006.01)

(52) U.S. Cl. ..... 601/112; 601/98

(58) Field of Classification Search ..... 601/49, 601/56–60, 84–87, 90, 91, 93, 94, 97–101, 601/103, 112, 113, 115, 116, 124, 126, 127, 601/133–136
See application file for complete search history.

(56) References Cited

U.S. PATENT DOCUMENTS 3,207,152 A 9/1965 Thornton
(Continued)

FOREIGN PATENT DOCUMENTS

CN 201244170 T 5/2009
(Continued)

*Primary Examiner* — Kristen Matter
(74) *Attorney, Agent, or Firm* — Morris Manning & Martin LLP; Tim Tingkang Xia, Esq.

(57) ABSTRACT

The present invention relates to a massage device. In one embodiment, the massage device includes a massage assembly and a transmission assembly for driving the massage assembly to provide massage effects. The massage assembly includes a driving shaft engaged with the transmission assembly and a pair of massage members. Each massage member has an eccentric wheel engaged with the driving shaft, a massage bracket engaged with the eccentric wheel, a guiding block in communication with the massage bracket, and a massage foot attached to the massage bracket.

16 Claims, 8 Drawing Sheets

U.S. PATENT DOCUMENTS

| | | | | |
|---|---|---|---|---|
| 3,800,785 | A | 4/1974 | Inada | |
| 5,020,518 | A | 6/1991 | Spears et al. | |
| 5,630,790 | A | 5/1997 | Ito | |
| 5,807,288 | A | 9/1998 | Wu | |
| 7,052,167 | B2 * | 5/2006 | Vanderschuit | 362/572 |
| 7,306,570 | B1 | 12/2007 | Julian | |
| 2003/0018284 | A1 * | 1/2003 | Lim | 601/98 |
| 2004/0049136 | A1 | 3/2004 | Lin | |
| 2004/0171972 | A1 | 9/2004 | Shimizu et al. | |
| 2005/0015029 | A1 | 1/2005 | Kim | |
| 2005/0020946 | A1 | 1/2005 | Kim | |
| 2005/0090770 | A1 | 4/2005 | Chen | |
| 2005/0096571 | A1 | 5/2005 | Miki | |
| 2005/0113723 | A1 | 5/2005 | Ueyama et al. | |
| 2005/0245851 | A1 * | 11/2005 | Ferber et al. | 601/86 |
| 2005/0256434 | A1 * | 11/2005 | Luo | 601/86 |
| 2006/0069331 | A1 | 3/2006 | Huang | |
| 2007/0118059 | A1 | 5/2007 | Luo | |
| 2008/0161736 | A1 | 7/2008 | Leifer | |

FOREIGN PATENT DOCUMENTS

| | | | |
|---|---|---|---|
| CN | 201469637 | U | 5/2010 |
| EP | 0809993 | A2 | 12/1997 |
| EP | 1145701 | A1 | 10/2001 |
| EP | 1400230 | A1 | 3/2004 |
| EP | 1568344 | A2 | 8/2005 |
| EP | 1595521 | A1 | 11/2005 |
| EP | 2080499 | A1 | 7/2009 |
| JP | 2000051302 | A | 2/2000 |
| WO | 01/60310 | A1 | 8/2001 |
| WO | 02/069880 | A1 | 9/2002 |
| WO | 02/094169 | A2 | 11/2002 |
| WO | 2008/036955 | A2 | 3/2008 |

* cited by examiner

MASSAGE DEVICE

CROSS-REFERENCE TO RELATED PATENT APPLICATION

This application is a continuation-in-part of U.S. patent application Ser. No. 11/625,255, filed Jan. 19, 2007, entitled "Massage Device," by Chi-Wu Chiang, now U.S. Pat. No. 7,731,672, which itself is a continuation-in-part of U.S. patent application Ser. No. 11/082,016, filed Mar. 16, 2005, entitled "Massage Device," by Chi-Wu Chiang, now abandoned, which itself claims priority to and the benefit of, pursuant to 35 USC §119(a), Chinese patent application Serial No. 2004200456092, filed May 11, 2004, which are incorporated herein in their entireties by reference.

This application is also a continuation-in-part of U.S. patent application Ser. No. 12/103,785, filed Apr. 16, 2008, entitled "A Massage Device," by Chi-Wu Chiang, now allowed, which itself claims priority to and the benefit of, pursuant to 35 USC §119(a), Chinese patent application Serial No. 200820091616.4, filed Jan. 15, 2008, entitled "A Massage Device," by Chi-Wu Chiang, which is incorporated herein by reference in its entirety.

This application also claims priority to and the benefit of, pursuant to 35 USC §119(a), Chinese patent application Serial No. 200920133730.3, filed Jul. 10, 2009, entitled "A Massage Device with Massaging Feet," by Chichun Wu, which is incorporated herein by reference in its entirety.

FIELD OF THE INVENTION

The present invention relates generally to a massage device, and more particularly to a massage device that utilizes a pair of massage feet to provide tapping massaging effects.

BACKGROUND OF THE INVENTION

Simulated massaging or kneading of parts of the body to aid circulation or relax the muscles has gained popularity, particularly, among people who are lack of exercise. The simulated massaging or kneading effects can be achieved electromagnetically and/or mechanically by means of a massage device. For the electromagnetic massaging or kneading, such a massage device is configured to generate a series of electromagnetic pulses, which are regularly directed to parts of interest of the body so as to perform massaging or kneading thereon. However, the massaging or kneading area of the massage device is limited, and the massaging or kneading effects may not be very gentle. For the mechanical massaging or kneading, the massage device is usually designed to have a plurality of massage nodes and a driving system to drive the plurality of massage nodes to rotate so as to simulate massaging or kneading when applied to parts of interest of the body. Comparing to the electromagnetic massaging, the limitation of the massaging or kneading area is improved for the mechanical massaging. However, mechanical massage devices are relatively complex and costly.

Therefore, a heretofore unaddressed need exists in the art to address the aforementioned deficiencies and inadequacies.

SUMMARY OF THE INVENTION

The present invention, in one aspect, relates to a massage device. In one embodiment, the massage device includes a base cover having a longitudinal axis and a plurality of guiding rails formed parallel to the longitudinal axis, and a rack mounted to the base cover and paralleled to the plurality of guiding rails.

The massage device further includes a carriage having a chassis member and a shield member placed over the chassis member to form a chamber therebetween, wherein the chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover.

The massage device also includes a transmission assembly received in the chamber and secured in the carriage. The transmission assembly has a motor having an output shaft, a worm mechanically coupled with the output shaft of the motor, a worm wheel meshing with the worm, a first gear meshing with the worm, a first pinion coaxially extended under the first gear, a second gear meshing with the first pinion, a second pinion coaxially extended under the second gear, a third gear meshing with the second pinion, and a third pinion coaxially extended under the third gear and meshing with the rack such that when the motor is activated, it drives the worm to rotate, the rotation of the worm results in the rotations of the worm wheel and the first gear, the rotation of the first gear results in, in turn, the rotations of the first pinion gear, the second gear, the second pinion gear, the third gear and the third pinion, thereby moving the carriage along the plurality of the guiding rails of the base cover. In one embodiment, the worm wheel and the first gear are arranged such that a rotation direction of the worm wheel is perpendicular to that of the first gear.

Furthermore, the massage device includes a massage assembly comprising a driving shaft and a pair of massage members. The driving shaft has a first end portion and an opposite, second end portion defining a shaft body therebetween, and is coaxially engaged with the worm wheel by the shaft body such that when the worm wheel rotates, the driving shaft rotates accordingly. Each massage member comprises an eccentric wheel, a massage bracket, a guiding block and a massage foot.

The eccentric wheel has a first surface, an opposite, second surface, a bolt shaft protruded eccentrically from the first surface and a recess formed on the second surface for receiving one of the first and second end portions of the driving shaft such that when the driving shaft rotates, the eccentric wheel rotates accordingly so that the bolt shaft moves circumferentially around the recess.

The massage bracket has a first end portion and a second end portion defining a bracket body therebetween, a guiding bar protruded laterally from the first end portion, and a bracket recess laterally formed in the bracket body for receiving the bolt shaft of the eccentric wheel such that when the bolt shaft of the eccentric wheel moves circumferentially, the massage bracket moves accordingly.

The guiding block is mounted onto the shield member of the carriage in relation to the massage bracket, and has a crescent-like guiding slot for receiving the guiding bar of the massage bracket such that when the massage bracket moves in response to the circumferential movement of the bolt shaft of the eccentric wheel, the guiding bar of the massage bracket moves back and forth along the crescent-like guiding slot.

The massage foot is mounted on the second end portion of the massage bracket such that when the guiding bar of the massage bracket moves back and forth along the crescent-like guiding slot of the guiding block, the massage foot taps back and forth along an arc line corresponding the crescent-like guiding slot of the guiding block.

In one embodiment, the massage foot comprises a curved foot board engaged with the massage bracket, where the curved foot board has a plurality of protrusions. The massage foot further comprises a plurality of bearings rotatably attached to the curved foot board. The massage foot may further comprise a plurality of energy sources engaged with the curved foot board for generating heat and/or light, where the plurality of energy sources comprises at least one of thermal and optical sources, and wherein the thermal source has at least one of cement resistors and heating lamps, and the optical source has a light. Additionally, the massage foot may also comprises a base mounted onto the second end portion of the massage bracket, a middle board secured to the base, wherein the plurality of energy sources is mounted onto the middle board, and wherein the curved foot board is positioned over the middle board and secured to the base.

In another aspect, the present invention relates to a massage device. In one embodiment, the massage device includes a massage assembly comprising a driving shaft and a pair of massage members. The driving shaft has a first end portion and an opposite, second end portion defining a shaft body therebetween.

Each massage member comprises an eccentric wheel, a massage bracket, a guiding block and a massage foot. The eccentric wheel has a first surface, an opposite, second surface, a bolt shaft protruded eccentrically from the first surface and a recess formed on the second surface for receiving one of the first and second end portions of the driving shaft such that when the driving shaft rotates, the eccentric wheel rotates accordingly so that the bolt shaft moves circumferentially around the recess. The massage bracket has a first end portion and a second end portion defining a bracket body therebetween, a guiding bar protruded laterally from the first end portion, and a bracket recess laterally formed in the bracket body for receiving the bolt shaft of the eccentric wheel such that when the bolt shaft of the eccentric wheel moves circumferentially, the massage bracket moves accordingly. The guiding block has a crescent-like guiding slot for receiving the guiding bar of the massage bracket such that when the massage bracket moves in response to the circumferential movement of the bolt shaft of the eccentric wheel, the guiding bar of the massage bracket moves back and forth along the crescent-like guiding slot. The massage foot is mounted on the second end portion of the massage bracket such that when the guiding bar of the massage bracket moves back and forth along the crescent-like guiding slot of the guiding block, the massage foot taps back and forth along an arc line corresponding the crescent-like guiding slot of the guiding block.

In one embodiment, the massage foot comprises a curved foot board engaged with the massage bracket, where the massage foot further comprises a plurality of bearings rotatably attached to the curved foot board. The massage foot may further comprises a plurality of energy sources engaged with the curved foot board for generating heat and/or light, wherein the plurality of energy sources comprises at least one of thermal and optical sources, and wherein the thermal source has at least one of cement resistors and heating lamps, and wherein the optical source has a light.

The massage device further has a base cover having a longitudinal axis and a plurality of guiding rails formed parallel to the longitudinal axis, a rack mounted to the base cover and paralleled to the plurality of guiding rails, and a carriage having a chassis member and a shield member placed over the chassis member to form a chamber therebetween, wherein the chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover.

The massage device also has a transmission assembly received in the chamber and secured in the carriage, wherein the transmission assembly comprises a motor 4 having an output shaft, a worm mechanically coupled with the output shaft of the motor, a worm wheel meshing with the worm, a first gear meshing with the worm, a first pinion coaxially extended under the first gear, a second gear meshing with the first pinion, a second pinion coaxially extended under the second gear, a third gear meshing with the second pinion, and a third pinion coaxially extended under the third gear and meshing with the rack such that when the motor is activated, it drives the worm to rotate, the rotation of the worm results in the rotations of the worm wheel and the first gear, the rotation of the first gear results in, in turn, the rotations of the first pinion gear, the second gear, the second pinion gear, the third gear and the third pinion, thereby moving the carriage along the plurality of the guiding rails of the base cover.

In one embodiment, the driving shaft is coaxially engaged with the worm wheel by the shaft body such that when the worm wheel rotates, the driving shaft rotates accordingly.

In operation, the motor drives the worm wheel and the first gear to rotate in perpendicular directions, wherein the rotation of the first gear drives the carriage to move along the plurality of the guiding rails of the base cover, and wherein the rotation of the worm wheel drives the pair of massage members to provide a tapping massage effect to a user.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
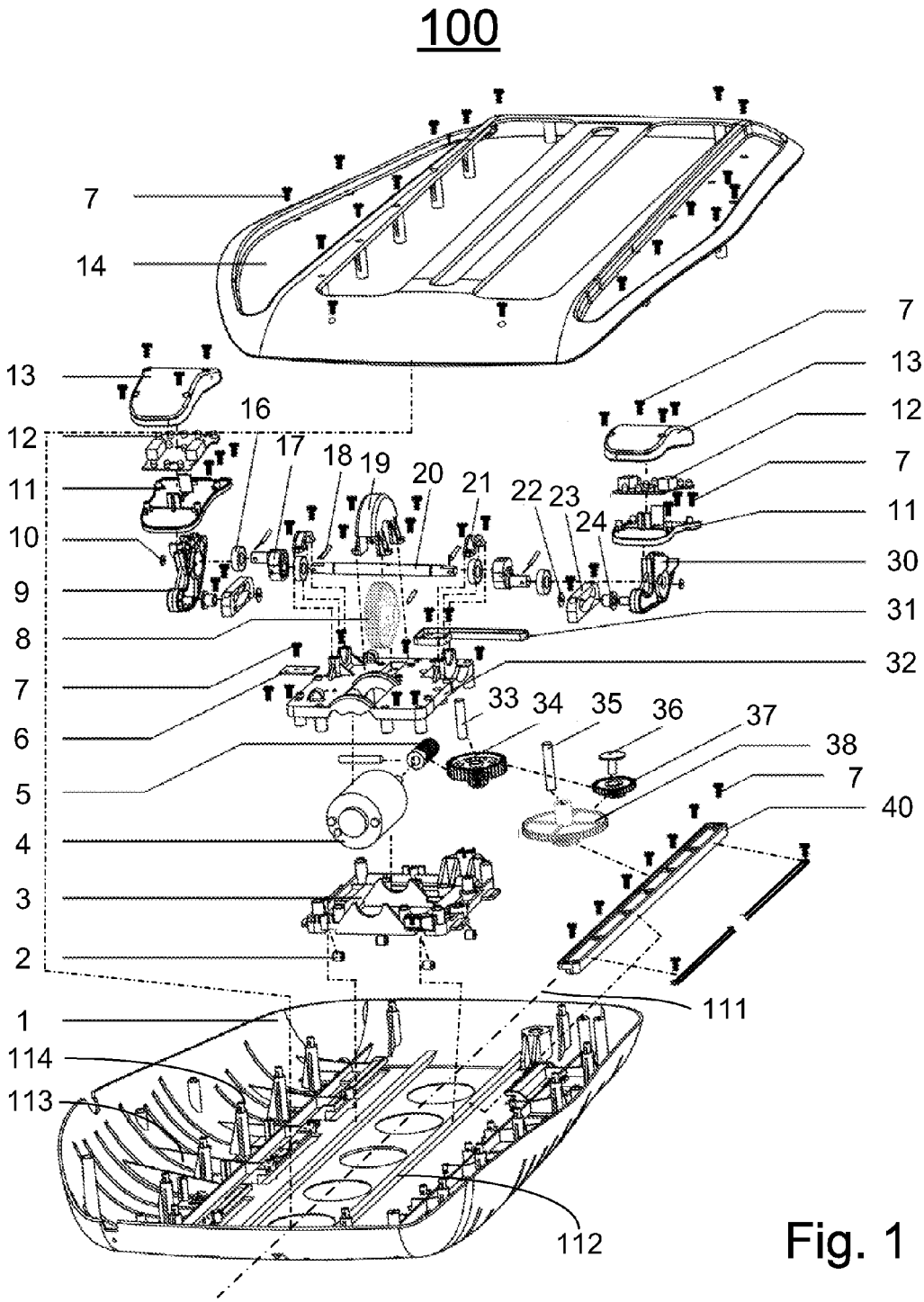
FIG. 1 shows an exploded view of a massage device according to one embodiment of the present invention.
Figure 2:
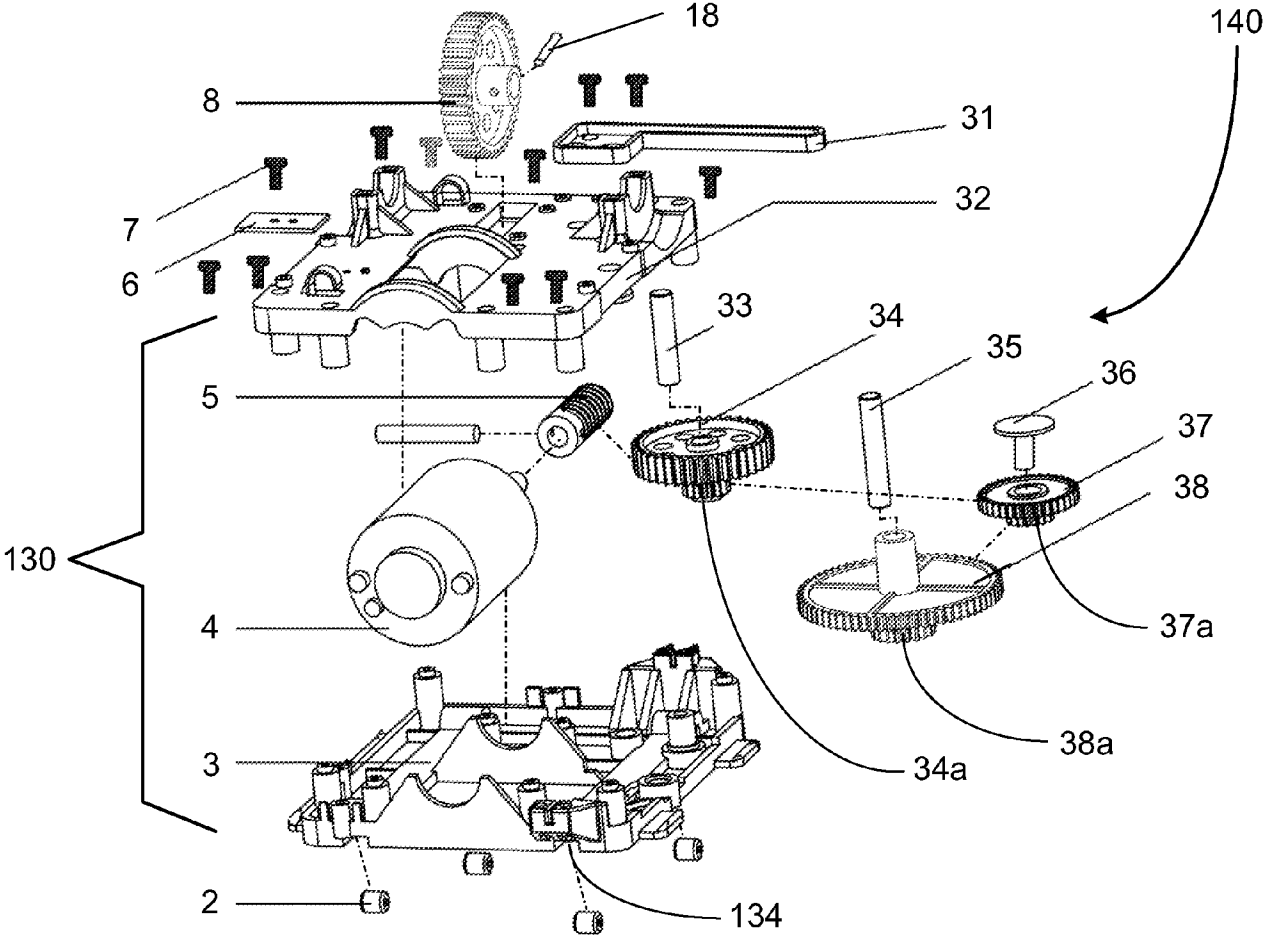
FIG. 2 shows a partially exploded view of the massage device as shown in FIG. 1.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to a massage device for providing tapping massaging effects.

Referring first to FIGS. 1-4, a massage device 100 is shown according to one embodiment of the present invention. The massage device 100 includes a base cover 1, a rack 40, a carriage 130, a transmission assembly 140 and a massage assembly 150 having a pair of massage members 151.

The base cover 1 has a longitudinal axis 111 and two guiding rails 112 formed parallel to the longitudinal axis 111. The two guiding rails 112 are adapted for cooperating with the carriage 130 and translating the pair of massage members 151 along the longitudinal axis 111. Other numbers of guiding rails 112 can also be utilized to practice the present invention. The rack 40 is mounted to the base cover 1 and paralleled to the plurality of guiding rails 112. The base cover 1 may also have a series of ribs 113 and supporting structures 114 for supporting and securing a top cover 14 to form a housing for accommodating the carriage 130, the transmission assembly 140 and the massage assembly 150 therein. The base cover 1 is made of a durable material, such as wood, plastic, alloy or the like.

The carriage 130 includes a chassis member 3 and a shield member 32 placed over the chassis member 3 to form a chamber therebetween. The chassis member 3 has two grooves 134 spaced-apart and formed on the bottom surface of the chassis member 3. The two grooves 134 are configured and sized to receive the two guiding rails 112 of the base cover 1, respectively. The cooperation of the guiding rails 112 of the base cover 1 and the grooves 134 of the chassis member 3 provides longitudinal guidance and support to the carriage 130 as it translates along the guiding rails 112. That is, when the carriage 130 is engaged with the base cover 1, the guiding rails 112 are respectively received in the grooves 134 of the chassis member 3 and the carriage 130 is longitudinally movable back and forth along the plurality of guiding rails 112 of the base cover 1. Other numbers of grooves can also be utilized to practice the present invention. The number of grooves is corresponding to the number of guiding rails 112 formed in the base cover 1. Additionally, the carriage 130 may also include a plurality of roller bearings 2, which are each pivotally connected to the carriage 130 and are offset from the grooves 134 and adjacent thereto for engaging a bearing surface provide upon each guiding rail 112. As the carriage 130 translates along the guiding rail 112, the carriage 130 is bearingly supported by the roller bearings 2 as they engage the surfaces provided by the guiding rails 112.

The transmission assembly 140 is received in the chamber and secured in the carriage 130. The transmission assembly 140 has a motor 4 having an output shaft, a worm 5 mechanically coupled with the output shaft of the motor 4, a worm wheel 8 meshing with the worm 5, a first gear 34 meshing with the worm 5, a first pinion 34*a* coaxially extended under the first gear 34, a second gear 37 meshing with the first pinion 34*a*, a second pinion 37*a* coaxially extended under the second gear 37, a third gear 38 meshing with the second pinion 37*a*, and a third pinion 38*a* coaxially extended under the third gear 38 and meshing with the rack 40. Under this arrangement, when the motor 4 is activated, it drives the worm 5 to rotate, the rotation of the worm 5 results in the rotations of the worm wheel 8 and the first gear 34, the rotation of the first gear 34 results in, in turn, the rotations of the first pinion gear 34*a*, the second gear 37, the second pinion 37*a*, the third gear 38 and the third pinion 38*a*, thereby moving the carriage 130 along the plurality of the guiding rails 112 of the base cover 1. In one embodiment, the worm wheel 8 and the first gear 34 are arranged such that a rotation direction of the worm wheel 8 is perpendicular to that of the first gear 34. The first gear 34 is also a worm wheel 8.

Generally, each of the first gear 34, the second gear 37 and the third gear 38 has a diameter that is larger than that of the first pinion 34*a*, and the second pinion 37*a* and the third pinion 38*a*, respectively. Additionally, each pair of the first gear 34 and the first pinion 34*a*, the second gear 37 and the second pinion 37*a*, and the third gear 38 and the third pinion 38*a* may be formed as a co-axially dual articulated gear.

The massage assembly 150 has a driving shaft 20 and a pair of massage members 151.

Figure 3:
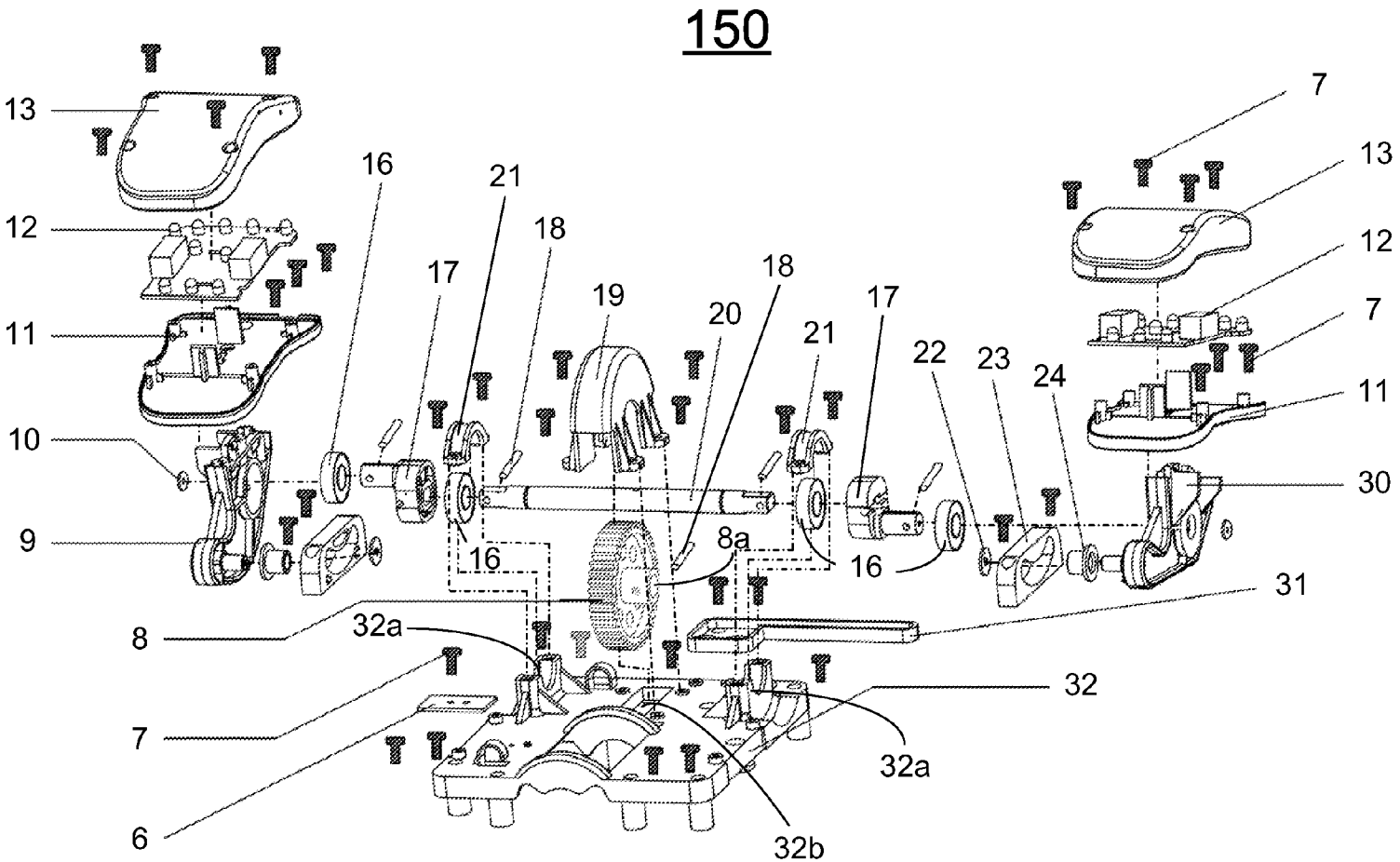
FIG. 3 shows another partially exploded view of the massage device as shown in FIG. 1.

The driving shaft 20 has a first end portion and an opposite, second end portion defining a shaft body therebetween, and is coaxially engaged with the worm wheel 8 by the shaft body such that when the worm wheel 8 rotates, the driving shaft 20 rotates accordingly. As shown in FIG. 3, in assembly, the driving shaft 20 is placed through a shaft bore 8*a* of the worm wheel 8, preferably, at the middle of the shaft body of the driving shaft 20. To ensure the worm wheel 8 and the driving shaft 20 to rotate synchronously, the worm wheel 8 and the driving shaft 20 are secured to together by a fastening pin 18. Furthermore, a shaft bearing 16 is placed on the shaft body of the driving shaft 20 at each side of the worm wheel 8. The shaft bearing 16 is configured such that the driving shaft 20 is freely rotatable back and forth. The worm wheel 8 is placed in an opening 32*b* defined in the shield member 32 of the carriage 130, and covered by a worm wheel bracket 19 that is, in turn, mounted onto the shield member 32 of the carriage 130. Additionally, each bearing 16 is placed in a corresponding bearing holding structure 32*a* of the shield member 32, and is covered by a bearing bracket 16 that is, in turn, mounted onto the corresponding bearing holding structure 32*a* of the shield member 32.

Each massage member 151 of the pair of massage members includes an eccentric wheel 17, a massage bracket 9 (30), a guiding block 23, and a massage foot 152.

The eccentric wheel 17 has a first surface, an opposite, second surface, a bolt shaft 17*a* protruded eccentrically from the first surface and a recess 17*b* formed on the second surface for receiving one of the first and second end portions of the driving shaft 20 such that when the driving shaft 20 rotates, the eccentric wheel 17 rotates accordingly so that the bolt shaft 17*a* moves circumferentially around the recess.

The structures of the massage brackets 9 and 30 are essentially same, but the massage brackets 30 is for the left-foot side massage member 151 and the massage brackets 9 is for the right-foot side massage member 151. Only the massage bracket 9 is described in details. The massage bracket 9 has a first end portion 9*a* and a second end portion 9*b* defining a bracket body 9*c* therebetween, a guiding bar 9*d* protruded laterally from the first end portion, and a bracket recess 9*e* laterally formed in the bracket body 9*c* for receiving the bolt shaft 17*a* of the eccentric wheel 17 such that when the bolt shaft 17*a* of the eccentric wheel 17 moves circumferentially, the massage bracket 9 moves accordingly.

The guiding block 23 is mounted onto the shield member 32 of the carriage 130 in relation to the massage bracket 9, and has a crescent-like guiding slot 23*a* for receiving the guiding bar 9*d* of the massage bracket 9 such that when the massage bracket 9 moves in response to the circumferential movement of the bolt shaft 17*a* of the eccentric wheel 17, the guiding bar 9*d* of the massage bracket 9 moves back and forth along the crescent-like guiding slot 23*a*.

The massage foot 152 is mounted on the second end portion 9*b* of the massage bracket 9 such that when the guiding bar 9*d* of the massage bracket 9 moves back and forth along the crescent-like guiding slot 23*a* of the guiding block 23, the massage foot 152 taps back and forth along an arc line corresponding the crescent-like guiding slot 23*a* of the guiding block 23.

Figure 4:
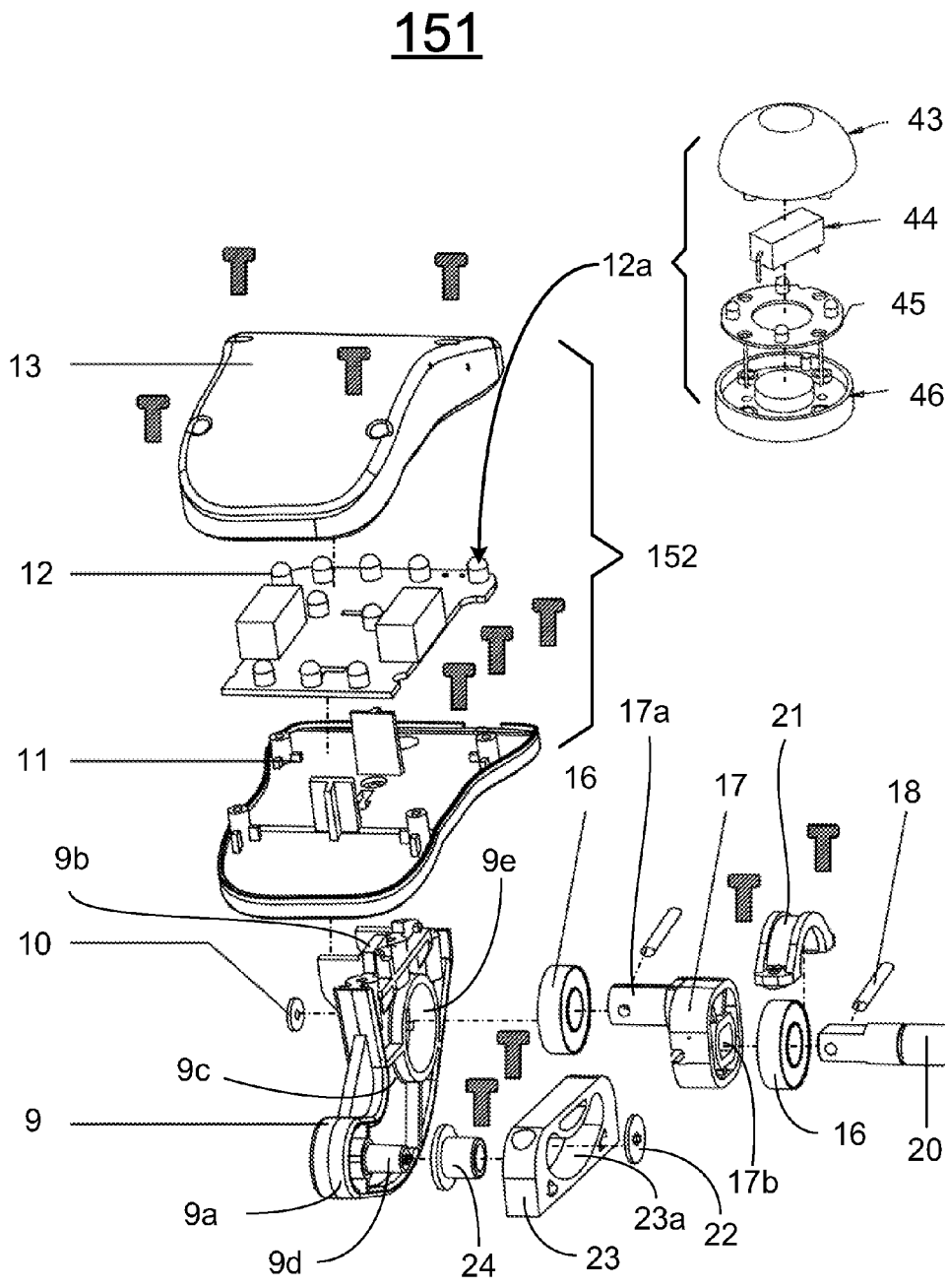
FIG. 4 shows yet another partially exploded view of the massage device as shown in FIG. 1.

As shown in FIG. 4, in assembly, an end portion of the driving shaft 20 is placed in the recess 17*b* of the eccentric wheel 17 and secured thereto by a fastening pin 18 so that the eccentric wheel 17 rotates synchronously around the driving shaft 20 when the driving shaft 20 rotates. The bolt shaft 17*a* of the eccentric wheel 17 is received by a shaft bearing 16 that is, in turn, received in the bracket recess 9*e* of the massage bracket 9. The shaft bearing 16 is configured such that the massage bracket 9 is rotatable relative to a bolt shaft 17*a* of the eccentric wheel 17. The guiding bar 9*d* of the massage bracket 9 receiving a bearing member 24 is placed in the crescent-like guiding slot 23*a* of the guiding block 23, so that the guiding bar 9*d* of the massage bracket 9 with the bearing member 24 is freely movable back and forth in the crescent-like guiding slot 23*a* of the guiding block 23. Additionally, a washer 22 is attached to the free end of the guiding bar 9*d* of the massage bracket 9. The massage foot 152 is mounted onto the second end portion of the massage bracket 9.

Additionally, fastening means such as fastening pins 18, 33, 35 and 36 and screws 7 may be applied wherever it is needed to secure various components of the massage device 100.

For such a massage device 100, in operation, the motor 4 drives the worm wheel 8 and the first gear 34 to rotate in perpendicular directions. The rotation of the first gear 34 drives the carriage 130 to move along the plurality of the guiding rails 112 of the base cover 1, while the rotation of the worm wheel 8 drives the pair of massage members 151 to provide a tapping massage effect to a user. Specifically, when the worm wheel 8 rotates, it drives the driving shaft 20 to rotate accordingly. The rotation of the driving shaft 20 results in the rotation of the eccentric wheel 17, thereby causing the bolt shaft 17*a* to move circumferentially around the recess 17*b* of the eccentric wheel 17 (or the driving shaft 20) at a radius that is corresponding to the distance between the bolt shaft 17*a* and the recess 17*b* of the eccentric wheel 17. The circumferential motion of the bolt shaft 17*a* of the eccentric wheel 17 results in the circumferential motion of the massage bracket 9 around the driving shaft 20 at the radius. Additionally, the massage bracket 9 also subjects to a motion back and forth along an arc line that is corresponding to the crescent-like guiding slot 23*a*. Therefore, the two motions cause the massage foot 152 mounted onto the massage bracket 9 to tap back and forth so as to provide tapping massaging effects.

In one embodiment, as shown in FIGS. 1-4, and particularly in FIG. 4, the massage foot 152 comprises a base 11 mounted onto the second end portion 9*b* of the massage bracket 9, a middle board 12 secured to the base 11, and a curved foot board 13 positioned over the middle board 12 and secured to the base 11.

The massage foot 152 also has a plurality of energy sources 12*a* mounted onto the middle board 12 for generating heat and/or light. The plurality of energy sources 12*a* includes at least one of thermal and optical sources. The thermal source may have at least one of cement resistors 44 and heating lamps. The optical source may have a light. In one embodiment shown in FIG. 4, the energy source 12*a* in includes a base frame 46 mounted onto the middle board 12, a PCT board 45 positioned over the base frame 46, a cement resistors 44 attached to the PCT board 45 and a cover 43 secured to the base frame 46 for covering the cement resistors 44.

The curved foot board 13 may have different structure so as to provide desired massaging effects. For example, the curved foot board 13 may include a plurality of protrusions (not shown) so as to provide desired kneading massage effects when in use. The protrusions may include the plurality of energy sources 12*a*.

Figure 5:
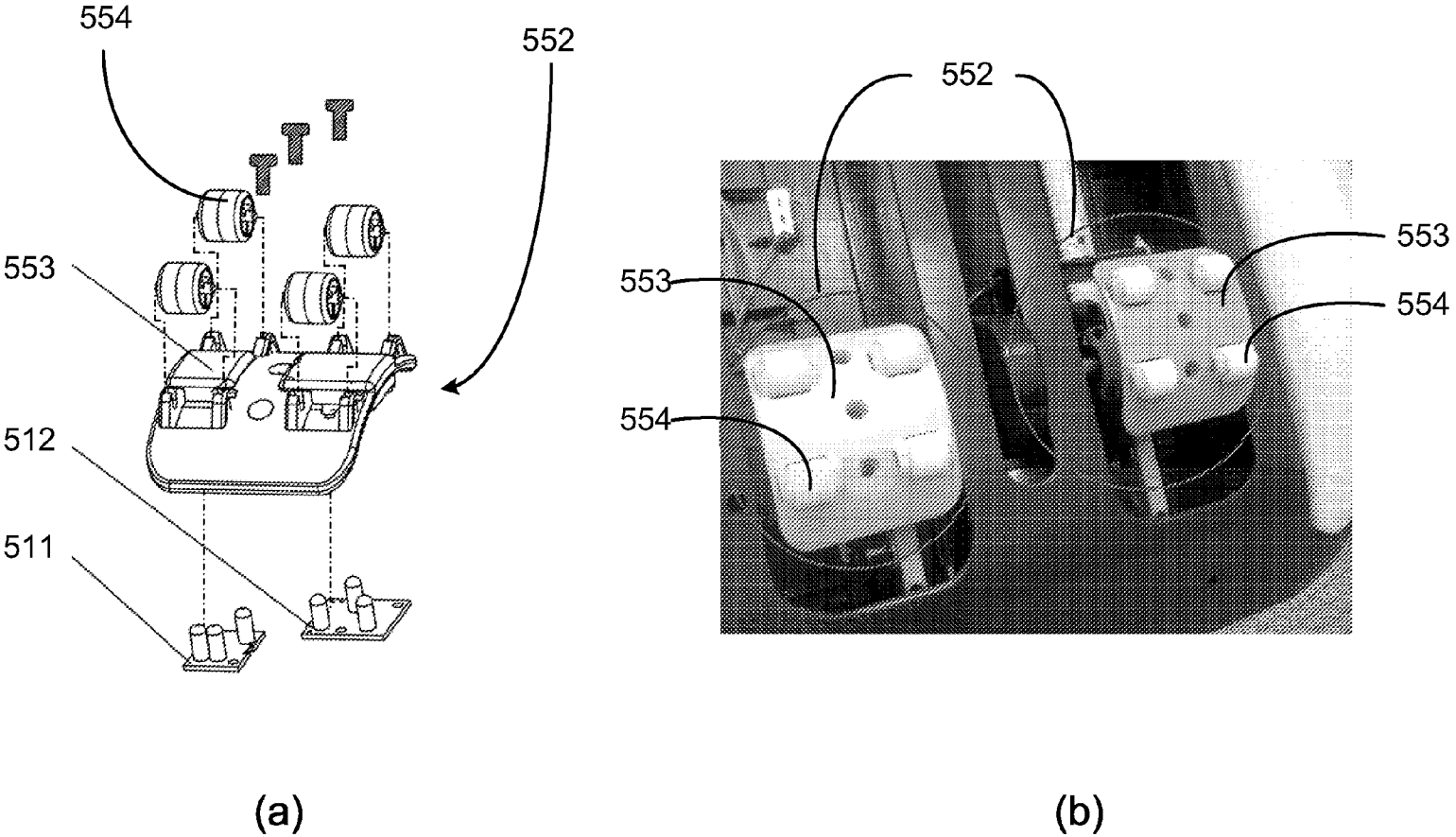
FIG. 5 shows partially a massage device according to another one embodiment of the present invention, (a) a partially exploded view, and (b) a partially perspective view.

Additionally, as shown in FIG. 5, the massage foot 552 includes a plurality of bearings 554 rotatably attached to the curved foot board 553. Additionally, the massage foot 552 also has a base 511 attached to the curved foot board 553, and a plurality of energy sources 512 including heating lamps and/or cement resistors, and lighting lamp and/or light emitting diodes (LEDs) mounted onto the base 511.

Figure 6:
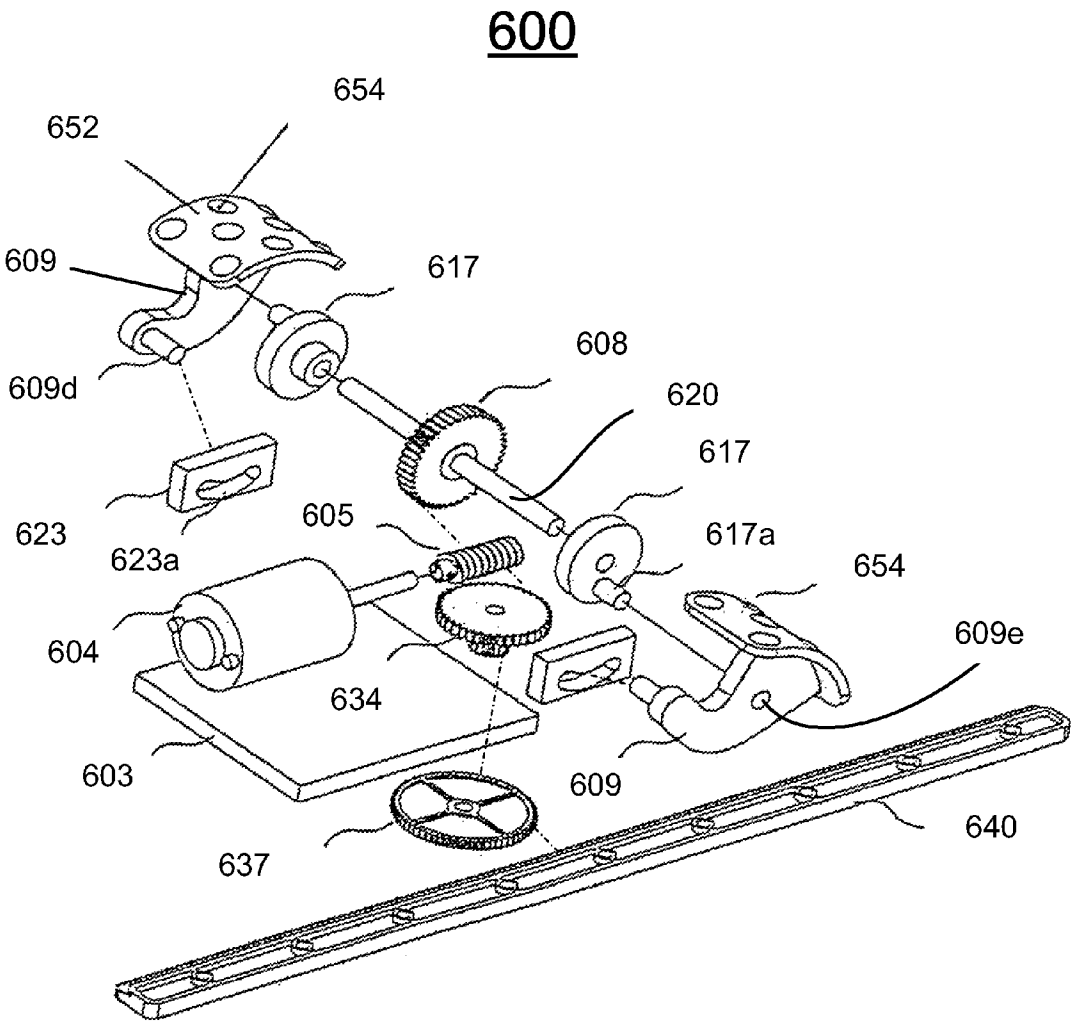
FIG. 6 shows a partially exploded view of a massage device according to one embodiment of the present invention.
Figure 7:
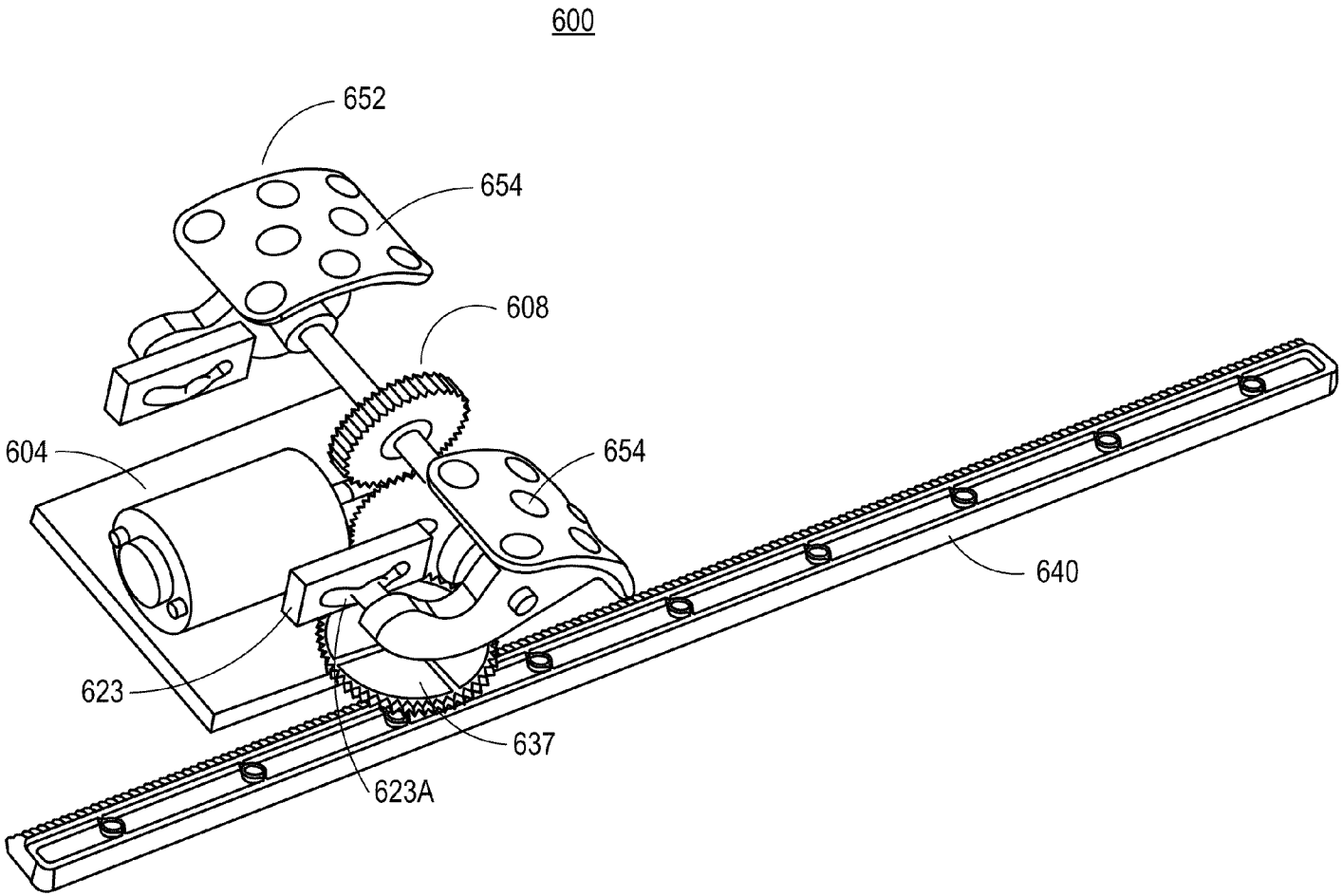
FIG. 7 shows a partially perspective view of the massage device as shown in FIG. 6.
Figure 8:
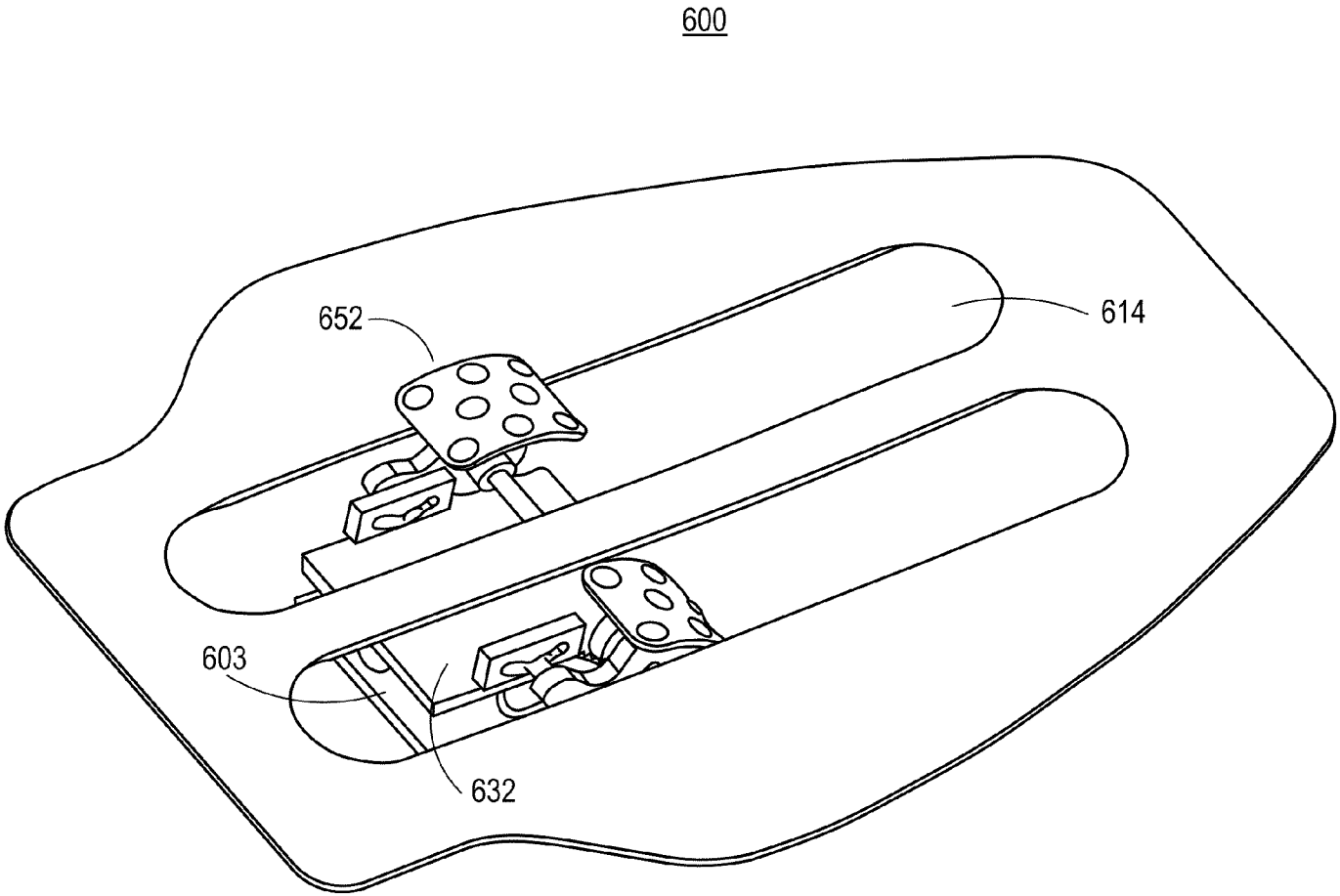
FIG. 8 shows another partially perspective view of the massage device as shown in FIG. 6.

FIGS. 6-8 show another embodiment of a massage device 600 according to present invention. Similar to the massage device shown in FIGS. 1-4, the massage device 600, among other things, has a transmission assembly and a message assembly.

The transmission assembly has a motor 604 having an output shaft, a worm 605 mechanically coupled with the output shaft of the motor 604, a worm wheel 608 meshing with the worm 605, a first gear 634 meshing with the worm 605, a first pinion coaxially extended under the first gear 634, a second gear 637 meshing with the first pinion, a second pinion coaxially extended under the second gear 637 and meshing with the rack 640.

The massage assembly has a driving shaft 620 and a pair of massage members. The driving shaft 20 has a first end portion and an opposite, second end portion defining a shaft body therebetween, and is coaxially engaged with the worm wheel 608 by the shaft body such that when the worm wheel 8 rotates, the driving shaft 20 rotates accordingly. Each massage member of the pair of massage members includes an eccentric wheel 617, a massage bracket 609, a guiding block 623, and a massage foot 652.

The eccentric wheel 617 has a first surface, an opposite, second surface, a bolt shaft protruded eccentrically from the first surface and a bore formed on the second surface for receiving one of the first and second end portions of the driving shaft 620 such that when the driving shaft 620 rotates, the eccentric wheel 617 rotates accordingly so that the bolt shaft moves circumferentially around the bore. The massage bracket 609 has a first end portion and a second end portion defining a bracket body therebetween, a guiding bar 609*d* protruded laterally from the first end portion, and a bore 609*e* formed through the bracket body for receiving the bolt shaft of the eccentric wheel 617 such that when the bolt shaft of the eccentric wheel 617 moves circumferentially, the massage bracket 609 moves accordingly. The guiding block 623 is mounted on the shielding member 632 and has a crescent-like guiding slot 623*a* for receiving the guiding bar 609*d* of the massage bracket 9 such that when the massage bracket 609 moves in response to the circumferential movement of the bolt shaft of the eccentric wheel 617, the guiding bar 609*d* of the massage bracket 609 moves back and forth along the crescent-like guiding slot 623*a*. The massage foot 652 is mounted on the second end portion of the massage bracket 609 such that when the guiding bar 609*d* of the massage bracket 609 moves back and forth along the crescent-like guiding slot 623*a* of the guiding block 623, the massage foot 652 taps back and forth along an arc line corresponding the crescent-like guiding slot 623*a* of the guiding block 623.

In this exemplary embodiment, the massage bracket 609 and the massage foot 652 are molded as a single member. Further, the massage foot 652 may have a plurality of thermal and/or optical sources 654.

For the exemplary embodiment of the massage device 600, in operation, when the motor 604 is activated, it drives the worm 605 to rotate, the rotation of the worm 605 results in the rotations of the worm wheel 608 and the first gear 634, the rotation of the first gear 634 results in, in turn, the rotations of the first pinion gear, the second gear 637, the second pinion gear, thereby moving the carriage 603 along the rack 640. The rotation of the worm wheel 608 results in the rotation of the driving shaft 20. The rotation of the driving shaft 620 results in the rotation of the eccentric wheel 617, which causes the bolt shaft of the eccentric wheel 617 to move circumferentially around the driving shaft 620. The circumferential motion of the bolt shaft of the eccentric wheel 617 results in the circumferential motion of the massage bracket 609 around the driving shaft 620. Additionally, the massage bracket 609 also subjects to a motion back and forth along an arc line that is corresponding to the crescent-like guiding slot 623*a*. Therefore, the two motions cause the massage foot 652 to tap back and forth so as to provide tapping massaging effects.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A massage device, comprising:

(a) a base cover having a longitudinal axis and a plurality of guiding rails formed parallel to the longitudinal axis;

(b) a rack mounted to the base cover and paralleled to the plurality of guiding rails;

(c) a carriage having a chassis member and a shield member placed over the chassis member to form a chamber therebetween, wherein the chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover;

(d) a transmission assembly received in the chamber and secured in the carriage, having a motor having an output shaft, a worm mechanically coupled with the output shaft of the motor, a worm wheel meshing with the worm, a first gear meshing with the worm, a first pinion coaxially extended under the first gear, a second gear meshing with the first pinion, a second pinion coaxially extended under the second gear, a third gear meshing with the second pinion, and a third pinion coaxially extended under the third gear and meshing with the rack such that when the motor is activated, it drives the worm to rotate, the rotation of the worm results in the rotations of the worm wheel and the first gear, the rotation of the first gear results in, in turn, the rotations of the first pinion, the second gear, the second pinion, the third gear and the third pinion, thereby moving the carriage along the plurality of the guiding rails of the base cover; and (e) a massage assembly comprising a driving shaft and a pair of massage members, wherein the driving shaft has a first end portion and an opposite, second end portion defining a shaft body therebetween, and is coaxially engaged with the worm wheel by the shaft body such that when the worm wheel rotates, the driving shaft rotates accordingly, and wherein each massage member comprises:

(i) an eccentric wheel having a first surface, an opposite, second surface, a bolt shaft protruded eccentrically from the first surface and a recess formed on the second surface for receiving one of the first and second end portions of the driving shaft such that when the driving shaft rotates, the eccentric wheel rotates accordingly so that the bolt shaft moves circumferentially around the recess;

(ii) a massage bracket having a first end portion and a second end portion defining a bracket body therebetween, a guiding bar protruded laterally from the first end portion, and a bracket recess laterally formed in the bracket body for receiving the bolt shaft of the eccentric wheel such that when the bolt shaft of the eccentric wheel moves circumferentially, the massage bracket moves accordingly;

(iii) a guiding block mounted onto the shield member of the carriage in relation to the massage bracket, having a crescent-like guiding slot for receiving the guiding bar of the massage bracket such that when the massage bracket moves in response to the circumferential movement of the bolt shaft of the eccentric wheel, the guiding bar of the massage bracket moves back and forth along the crescent-like guiding slot; and (iv) a massage foot mounted on the second end portion of the massage bracket such that when the guiding bar of the massage bracket moves back and forth along the crescent-like guiding slot of the guiding block, the massage foot taps back and forth along an arc line corresponding to the crescent-like guiding slot of the guiding block.

2. The massage device of claim 1, wherein the worm wheel and the first gear are arranged such that a rotation direction of the worm wheel is perpendicular to that of the first gear.

3. The massage device of claim 1, wherein the massage foot comprises a curved foot board engaged with the massage bracket.

4. The massage device of claim 3, wherein the curved foot board has a plurality of protrusions.

5. The massage device of claim 3, wherein the massage foot further comprises a plurality of bearings rotatably attached to the curved foot board.

6. The massage device of claim 3, wherein the massage foot further comprises a plurality of energy sources engaged with the curved foot board for generating heat and/or light.

7. The massage device of claim 6, wherein the plurality of energy sources comprises at least one of thermal and optical sources, and wherein the thermal source has at least one of cement resistors and heating lamps, and wherein the optical source has a light.

8. The massage device of claim 6, wherein the massage foot further comprises a base mounted onto the second end portion of the massage bracket, a middle board secured to the base, wherein the plurality of energy sources is mounted onto the middle board, and wherein the curved foot board is positioned over the middle board and secured to the base.

9. A massage device, comprising a massage assembly comprising a driving shaft and a pair of massage members, wherein the driving shaft has a first end portion and an opposite, second end portion defining a shaft body therebetween, and wherein each massage member comprises:

(a) an eccentric wheel having a first surface, an opposite, second surface, a bolt shaft protruded eccentrically from the first surface and a recess formed on the second surface for receiving one of the first and second end portions of the driving shaft such that when the driving shaft rotates, the eccentric wheel rotates accordingly so that the bolt shaft moves circumferentially around the recess;

(b) a massage bracket having a first end portion and a second end portion defining a bracket body therebetween, a guiding bar protruded laterally from the first end portion, and a bracket recess laterally formed in the bracket body for receiving the bolt shaft of the eccentric wheel such that when the bolt shaft of the eccentric wheel moves circumferentially, the massage bracket moves accordingly;

(c) a guiding block having a crescent-like guiding slot for receiving the guiding bar of the massage bracket such that when the massage bracket moves in response to the circumferential movement of the bolt shaft of the eccentric wheel, the guiding bar of the massage bracket moves back and forth along the crescent-like guiding slot; and (d) a massage foot mounted on the second end portion of the massage bracket such that when the guiding bar of the massage bracket moves back and forth along the crescent-like guiding slot of the guiding block, the massage foot taps back and forth along an arc line corresponding to the crescent-like guiding slot of the guiding block.

10. The massage device of claim 9, further comprising:

(a) a base cover having a longitudinal axis and a plurality of guiding rails formed parallel to the longitudinal axis;

(b) a rack mounted to the base cover and paralleled to the plurality of guiding rails; and (c) a carriage having a chassis member and a shield member placed over the chassis member to form a chamber therebetween, wherein the chassis member has a plurality of grooves formed such that when the carriage is engaged with the base cover, the plurality of guiding rails is received in the plurality of grooves of the chassis member and the carriage is longitudinally movable back and forth along the plurality of guiding rails of the base cover.

11. The massage device of claim 10, further comprising a transmission assembly received in the chamber and secured in the carriage, wherein the transmission assembly comprises a motor having an output shaft, a worm mechanically coupled with the output shaft of the motor, a worm wheel meshing with the worm, a first gear meshing with the worm, a first pinion coaxially extended under the first gear, a second gear meshing with the first pinion, a second pinion coaxially extended under the second gear, a third gear meshing with the second pinion, and a third pinion coaxially extended under the third gear and meshing with the rack such that when the motor is activated, it drives the worm to rotate, the rotation of the worm results in the rotations of the worm wheel and the first gear, the rotation of the first gear results in, in turn, the rotations of the first pinion, the second gear, the second pinion, the third gear and the third pinion, thereby moving the carriage along the plurality of the guiding rails of the base cover.

12. The massage device of claim 11, wherein the driving shaft is coaxially engaged with the worm wheel by the shaft body such that when the worm wheel rotates, the driving shaft rotates accordingly.

13. The massage device of claim 12, wherein in operation, the motor drives the worm wheel and the first gear to rotate in perpendicular directions, wherein the rotation of the first gear drives the carriage to move along the plurality of the guiding rails of the base cover, and wherein the rotation of the worm wheel drives the pair of massage members to provide a tapping massage effect to a user.

14. The massage device of claim 9, wherein the massage foot comprises a curved foot board engaged with the massage bracket.

15. The massage device of claim 14, wherein the massage foot further comprises a plurality of bearings rotatably attached to the curved foot board.

16. The massage device of claim 14, wherein the massage foot further comprises a plurality of energy sources engaged with the curved foot board for generating heat and/or light, wherein the plurality of energy sources comprises at least one of thermal and optical sources, and wherein the thermal source has at least one of cement resistors and heating lamps, and wherein the optical source has a light.

* * * * *